US009653034B2

(12) United States Patent
Cho et al.

(10) Patent No.: US 9,653,034 B2
(45) Date of Patent: May 16, 2017

(54) COLUMN DATA DRIVING CIRCUIT INCLUDING A PRECHARGE UNIT, DISPLAY DEVICE WITH THE SAME, AND DRIVING METHOD THEREOF

(75) Inventors: Ki-Seok Cho, Chungcheongbuk-do (KR); Hee-Jung Kim, Chungcheongbuk-do (KR); Dae-Ho Lim, Chungcheongbuk-do (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 627 days.

(21) Appl. No.: 12/475,041

(22) Filed: May 29, 2009

(65) Prior Publication Data

US 2010/0045638 A1 Feb. 25, 2010

(30) Foreign Application Priority Data

Aug. 19, 2008 (KR) ..... 10-2008-0080969

(51) Int. Cl.
*G09G 3/36* (2006.01)

(52) U.S. Cl.
CPC ... *G09G 3/3688* (2013.01); *G09G 2300/0417* (2013.01); *G09G 2310/0248* (2013.01); *G09G 2310/0297* (2013.01)

(58) Field of Classification Search
CPC ..... G09G 5/00; G09G 2310/0286; G09G 3/3685; G09G 3/3688; G09G 3/3692; G09G 345/10; G09G 2310/0243; G09G 2310/08; G09G 3/3696; G09G 345/99; G09G 345/98; G09G 2300/0482; G09G 2300/0842; G09G 2300/0847; G09G 2300/0852; G09G 2300/0857
USPC ..... 345/87–103
See application file for complete search history.

(56) References Cited

U.S. PATENT DOCUMENTS 6,061,046 A * 5/2000 An ..... 345/98
6,307,681 B1 * 10/2001 Aoki ..... G09G 3/3648 340/14.1
6,816,144 B2 11/2004 Tsuchi
(Continued)

FOREIGN PATENT DOCUMENTS

CN 1677473 A 10/2005
JP 2002-149125 5/2002
(Continued)

OTHER PUBLICATIONS

"Mobile TFT Driver IC Design", Jae Ho Park, Senior researcher (Samsung Electronics) (Workshop on FPD Driver LSI Design, vol. 2: Mobile Display); Presented Nov. 21, 2006.
(Continued)

*Primary Examiner* — Grant Sitta
(74) *Attorney, Agent, or Firm* — NSIP Law

(57) ABSTRACT

Provided are a column data driver configured to apply a voltage or current corresponding to image data to a display panel, a display device having the column data driver, and a driving method of the display device. The column data driving circuit includes a precharge unit configured to precharge at least one of a plurality of column lines in response to a plurality of preset signals corresponding to image data; and a driving unit configured to sequentially drive the plurality of column lines in response to a data signal corresponding to the image data.

22 Claims, 12 Drawing Sheets

(56) References Cited

U.S. PATENT DOCUMENTS

| | | | | |
|---|---|---|---|---|
| 6,924,784 | B1 * | 8/2005 | Yeo | G09G 3/3688 345/100 |
| 6,985,130 | B2 | 1/2006 | Nakayoshi et al. | |
| 7,333,098 | B2 * | 2/2008 | Kobayashi | G09G 3/3688 345/204 |
| 7,425,942 | B2 * | 9/2008 | Lee | G09G 3/2011 345/560 |
| 7,545,394 | B2 | 6/2009 | Nose et al. | |
| 7,629,952 | B2 * | 12/2009 | Burr et al. | 345/87 |
| 7,692,641 | B2 | 4/2010 | Kudo et al. | |
| 7,855,710 | B2 | 12/2010 | Ito | |
| 8,390,603 | B2 * | 3/2013 | Yi | G09G 3/3648 205/206 |
| 2003/0006955 | A1 * | 1/2003 | Tsuchi | G09G 3/3688 345/92 |
| 2003/0085885 | A1 | 5/2003 | Nakayoshi et al. | |
| 2005/0083319 | A1 * | 4/2005 | Kodate | G09G 3/3659 345/204 |
| 2005/0219276 | A1 | 10/2005 | Nose et al. | |
| 2006/0087488 | A1 | 4/2006 | Ito | |
| 2006/0164363 | A1 * | 7/2006 | Battersby et al. | 345/98 |
| 2006/0227638 | A1 | 10/2006 | Kudo et al. | |
| 2006/0290611 | A1 * | 12/2006 | Tsuge | 345/74.1 |
| 2008/0225189 | A1 * | 9/2008 | Yang | G09G 3/3659 349/37 |
| 2010/0165011 | A1 | 7/2010 | Kudo et al. | |

FOREIGN PATENT DOCUMENTS

| | | |
|---|---|---|
| JP | 2003-140626 | 5/2003 |
| JP | 2003-167556 | 6/2003 |
| JP | 2004-045967 | 2/2004 |
| JP | 2005-351963 | 12/2005 |
| JP | 2006-154745 | 6/2006 |
| JP | 2006-267675 | 10/2006 |
| JP | 2007-263989 | 10/2007 |
| KR | 10-2005-0046593 | 5/2005 |
| KR | 10-2006-0103081 | 9/2006 |

OTHER PUBLICATIONS

Chinese First Office Action issued Sep. 8, 2011, in counterpart Chinese Patent Application No. 200910166493.5 (13 pages including complete English translation).

Japanese Office Action issued Oct. 16, 2012 in counterpart Japanese Patent Application No. 2009-142944 (3 pages, in Japanese).

Japanese Office Action issued on Feb. 12, 2013 in counterpart Japanese Patent Application No. 2009-14294. (2 pages in Japanese).

* cited by examiner

COLUMN DATA DRIVING CIRCUIT INCLUDING A PRECHARGE UNIT, DISPLAY DEVICE WITH THE SAME, AND DRIVING METHOD THEREOF

CROSS-REFERENCE TO RELATED APPLICATIONS

This application claims the benefit under 35 U.S.C. §119 (a) of Korean Patent Application No. 10-2008-0080969, filed on Aug. 19, 2008, the entire disclosure of which is incorporated herein by reference for all purposes.

BACKGROUND OF THE INVENTION

Field of the Invention

The following description relates to a display device, and, for example, to a column data driver configured to apply a voltage or current corresponding to image data to a display panel, a display device having the column data driver, and a driving method of the display device.

Description of Related Art

In general, a liquid crystal display device (LCD), which is one of display devices, displays an image by controlling the light transmittance of liquid molecules with dielectric anisotropy using an electric field. To this end, the LCD includes a liquid crystal panel provided with a plurality of pixels arranged in a matrix form, and a driving circuit configured to drive the liquid crystal panel.

The liquid crystal panel includes a plurality of gate lines (hereinafter, referred to as 'row lines') and a plurality of column lines (hereinafter, referred to as 'column lines') crossing the plurality of gate lines. The pixels are arranged in regions where the row lines and the column lines cross each other. Pixel electrodes and a common electrode are formed so as to apply an electric field to each of the pixels. Each of the pixels contacts a switching element, e.g., a thin film transistor (hereinafter, referred to as TFT).

The driving circuit includes a row data driver configured to drive the row lines, a column data driver configured to drive the column lines, a timing controller configured to supply a control signal used to control the row data driver and the column data driver, and a common electrode voltage generator configured to supply a common electrode voltage to the liquid crystal panel.

FIG. 1 is a block diagram of an LCD including a conventional column data driver. FIG. 1 exemplarily illustrates a liquid crystal panel having 2×3 configuration in an M-by-N matrix (M and N are positive integers).

Referring to FIG. 1, the conventional LCD includes a liquid crystal panel 110, a row data driver 120, a column data driver 130, and a timing controller (not shown).

The liquid crystal panel 110 includes a plurality of row lines RL1 to RLm, a plurality of column lines CL1 to CLn, and a plurality of pixels Px arranged in regions where the row lines RL1 to RLm and the column lines CL1 to CLn cross each other. The pixel Px includes a switch 112 and a liquid crystal 111.

The row data driver 120 controls the switch 112 of each pixel in a row direction of the liquid crystal panel 110. To be specific, the row data driver 120 sequentially outputs scan pulses to the switch 112 in response to a gate control signal supplied from the timing controller.

The column data driver 130 outputs a data signal corresponding to image data input in response to a data control signal of the timing controller, to the column lines CL1 to CLn.

The column data driver 130 includes a digital-to-analog converter (DAC) 133, buffers 132_1 to 132_3, and column switches SW1 to SW3. The DAC 133 receives the image data to convert them into analog signals. The buffers 132_1 to 132_3 receive the respective analog signals (data signals) output from the DAC 133 to drive column lines of the liquid crystal panel 110. The column switches SW1 to SW3 transfer the data signals buffered through the buffers 132_1 to 132_3 to the corresponding column lines CL1 to CLn, respectively.

FIG. 2 is an operation waveform diagram illustrating the operation of the LCD of FIG. 1.

Referring to FIG. 2, the column switches SW1 to SW3 are simultaneously turned on or off in general. The row lines RL1 to RLm transfer the scan pulses to the switches 112 in sequence. A voltage or current corresponding to the data signal is applied to the column lines CL1 to CLn when the column switches SW1 to SW3 are turned on. At this time, there is a slewing due to a time delay (RC delay) of the pixel. The slewing is a critical factor to charge the pixel. When the slewing is too slow, it is difficult to display an image correctly.

FIG. 3 is a block diagram of another conventional LCD. Number of buffers in a column data driver of the conventional LCD of FIG. 3 is reduced compared to the conventional LCD of FIG. 1.

Referring to FIG. 3, a column data driver 140 includes a DAC 143, a buffer 142, and a plurality of column switches SW1 to SW3. The plurality of column switches SW1 to SW3 are connected to one buffer 142. Accordingly, to transfer the data signal output from the buffer 142 to a plurality of column lines CL1 to CL3 correspondingly, the data signal of the buffer 142 is sequentially transferred to the column lines CL1 to CL3 through the column switches SW1 to SW3 while the row line RL1 is enabled. Such an operating method is called a time-sharing method.

FIG. 4 is an operation waveform diagram of the LCD of FIG. 3, illustrating a time-sharing method. A solid line in the waveform diagram of each of the column lines CL1 to CL3 denotes a duration during which a data signal is actually output from the buffer of the column data driver, whereas a dotted line denotes a duration during which the data signal of the buffer is in a floating state because each column switch SW1 to SW3 is turned off.

As illustrated in FIG. 4, a time-sharing operation should be performed using the column switches SW1 to SW3 during the activation of the same row line, e.g., RL1 or RL2, in the conventional LCD of FIG. 3 employing the time-sharing method. Therefore, a slew margin of the buffer 142 becomes poorer compared to the conventional LCD of FIG. 1.

While number (k) of buffers, i.e., time-sharing channels, in FIG. 3 is 3, it is possible to arbitrarily change the number (k) to, for example, k=2, 6, 12, etc., depending on characteristics of the column data driver and the liquid crystal panel. However, as the number of buffers performing the time-sharing operation becomes greater, a settling time margin of the data signal of the buffer, i.e., a settling time margin of an output voltage or output current gets shorter because the allowed time for settling is in inverse proportion to the number (k).

To solve the above-described limitations, a liquid crystal panel using a low temperature polysilicon (LTPS) technique has been developed to reduce a signal delay time or settling time due to parasitic resistance and capacitance in the liquid crystal panel, which leads to an increase in cost in comparison with existing TFT panels.

SUMMARY

Embodiments generally are directed to provide a column data driving circuit, a display device having the same, and a driving method thereof, which can reduce a chip size and power consumption by reducing number of buffers in a column data driver using a time-sharing method even in typical TFT panels.

In accordance with a general aspect, there is provided a column data driving circuit, which includes: a precharge unit configured to precharge at least one of a plurality of column lines in response to a plurality of preset signals corresponding to image data; and a driving unit configured to sequentially drive the plurality of column lines in response to a data signal corresponding to the image data.

In accordance with another general aspect, there is provided a display device, which includes: a display panel comprising pixels arranged in regions where a plurality of row lines and a plurality of column lines cross each other; a row data driver configured to drive the plurality of row lines; and a column data driver configured to drive the plurality of column lines. Herein, the column data driver includes: a precharge unit configured to precharge at least one of a plurality of column lines in response to a plurality of preset signals corresponding to image data; and a driving unit configured to sequentially drive the plurality of column lines in response to a data signal corresponding to the image data.

In accordance with yet another general aspect, there is provided a driving method of a display device including a display panel including a plurality of pixels arranged in regions where a plurality of row lines and a plurality of column lines cross each other, the driving method including: driving one of the plurality of column lines using a data signal, and simultaneously precharging the other column lines in response to a plurality of preset signals; and sequentially driving the column lines precharged by the preset signal in response to the data signal.

DETAILED DESCRIPTION OF SPECIFIC EMBODIMENTS

Figure 1:
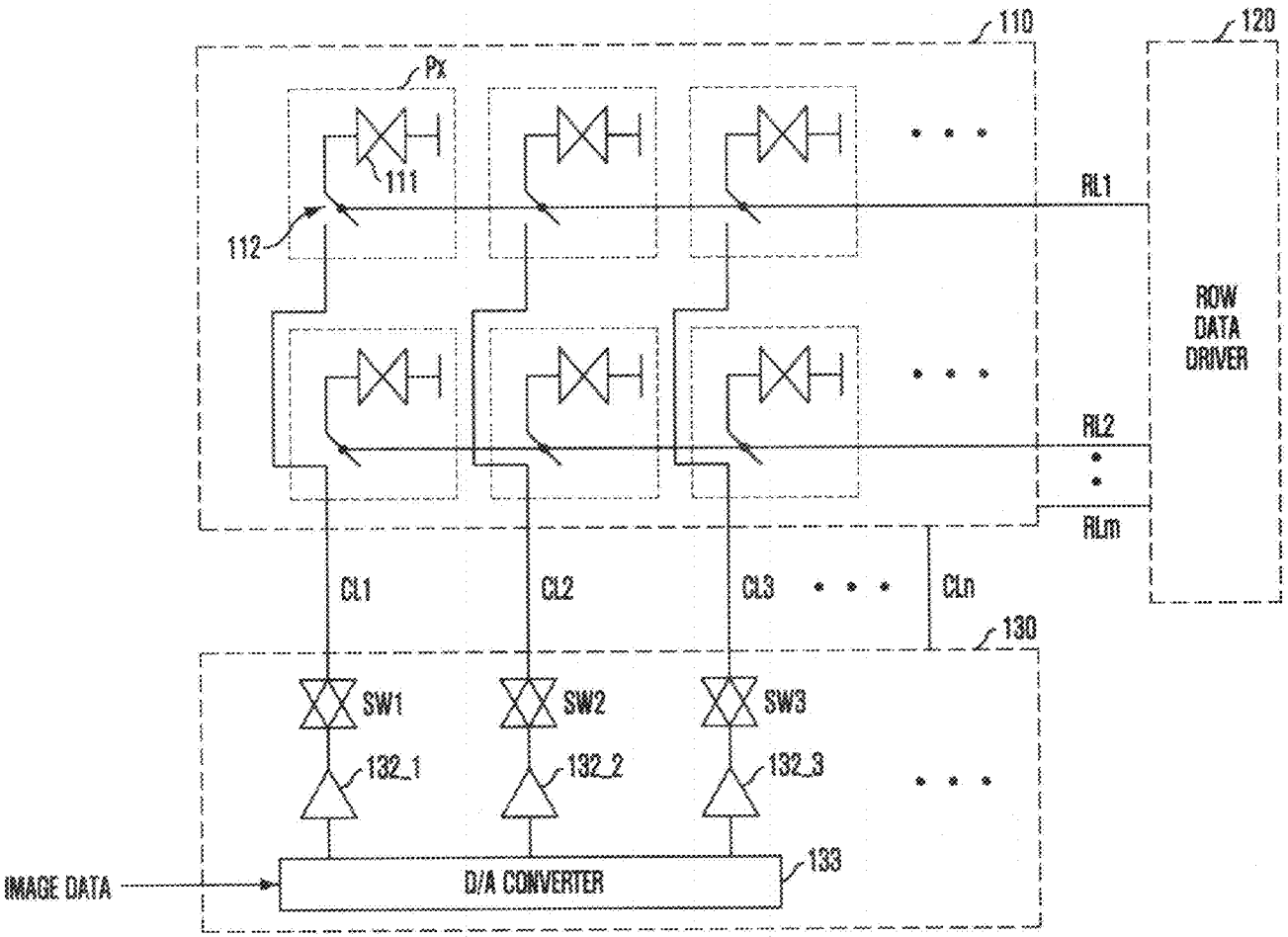
FIG. 1 (RELATED ART)
FIG. 1 is a block diagram of a conventional liquid crystal display device (LCD).
Figure 2:
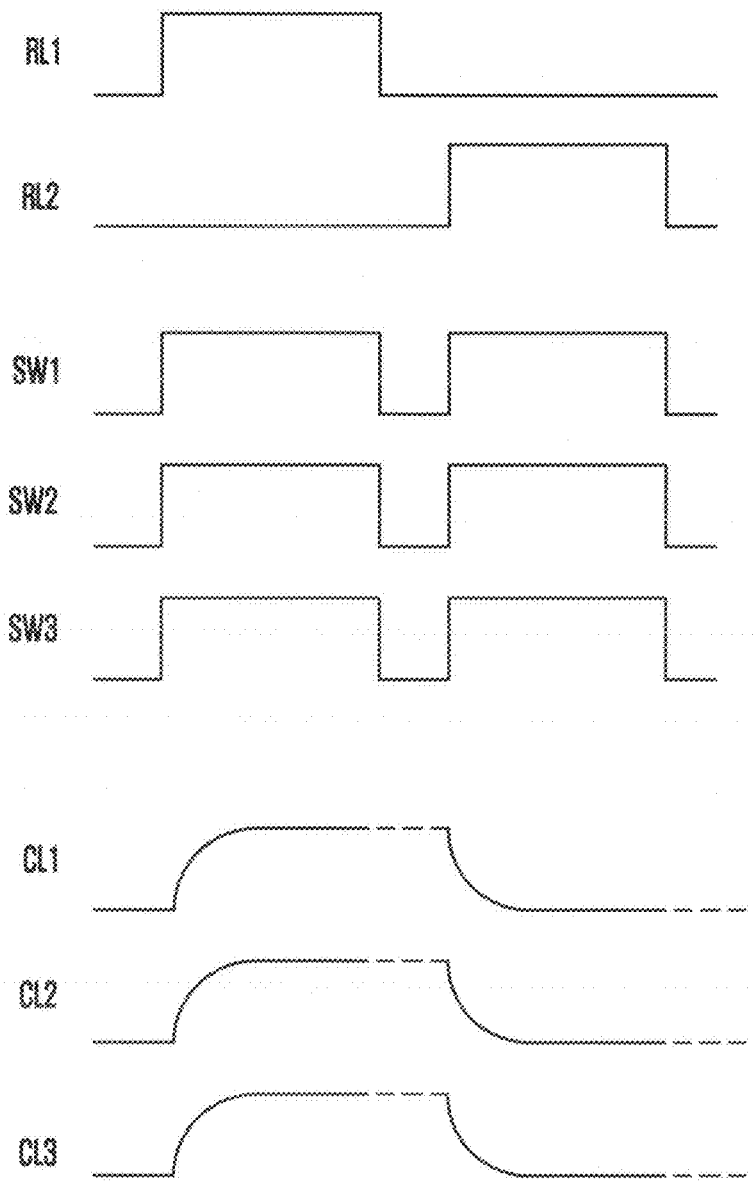
FIG. 2 (RELATED ART)
FIG. 2 is an operation waveform diagram illustrating the operation of the LCD of FIG. 1.
Figure 3:
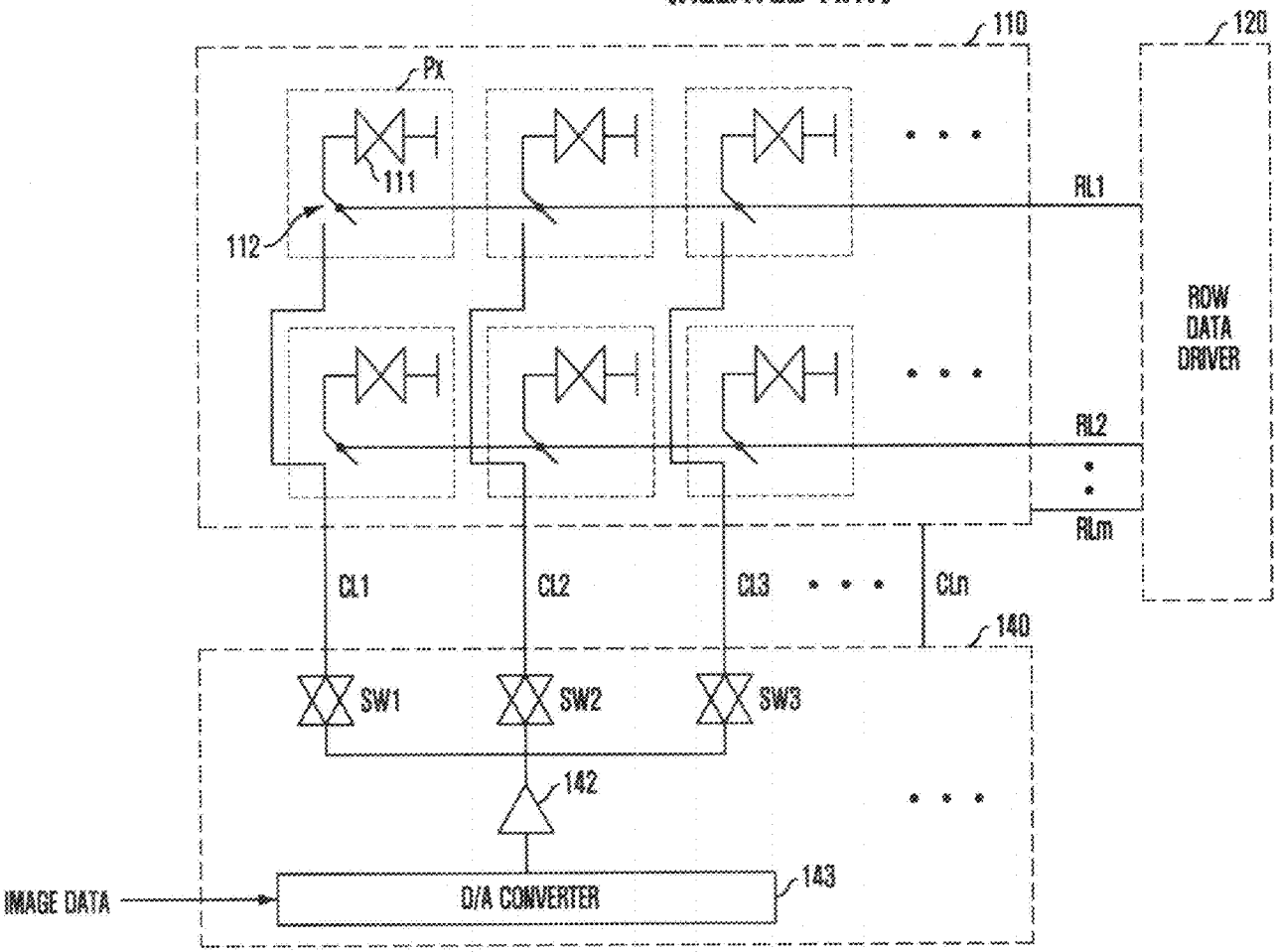
FIG. 3 (RELATED ART)
FIG. 3 is a block diagram of another conventional LCD.

Other elements and features can be understood by the following description, and become apparent with reference to the general aspects. All variables described herein, for example, 'n', 'm', and 'k', are natural numbers. Throughout this specification, like reference numerals (or, reference symbols) denote like elements.

Figure 5:
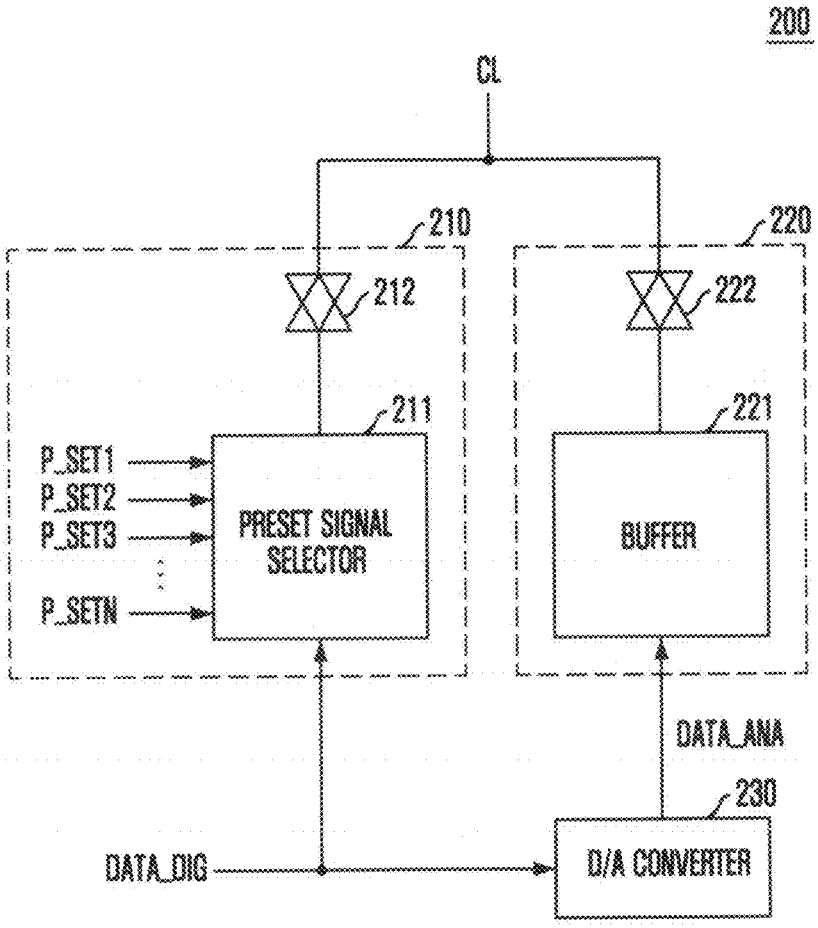
FIG. 5 is a block diagram illustrating an example of a column data driving circuit in accordance with a general aspect.

FIG. 5 is a block diagram illustrating an example of a column data driving circuit 200 in accordance with a general aspect. As an example of a general aspect, a driving circuit of driving one column line will be described.

Referring to FIG. 5, the column data driving circuit 200 includes a precharge unit 210 configured to precharge a column line CL in response to corresponding one of preset signals P_SET1 to P_SETN corresponding to image data DATA_DIG, and a driving unit 220 configured to drive the column line CL in response to a data signal DATA_ANA corresponding to the image data DATA_DIG.

The precharge unit 210 includes a preset signal selector 211 configured to select one of the preset signals P_SET1 to P_SETN that corresponds to the image data DATA_DIG input currently, and a preset signal transfer unit 212 configured to transfer one of the preset signals P_SET1 to P_SETN output from the preset signal selector 211 to thereby precharge the column line CL.

The preset signal selector 211 may include a decoder. Alternatively, the preset signal selector 211 may include a multiplexer. The preset signal transfer unit 212 may include a transfer gate. The transfer gate may be provided with an NMOS transistor and a PMOS transistor. For example, the transfer gate may include NMOS and PMOS transistors connected to each other in parallel. That is, the transfer gate has a structure where a source of one transistor is connected to a drain of the other transistor. The complementary control signals are input to both gates of the NMOS and PMOS transistors.

The driving unit 220 includes a buffer 221 configured to buffer the data signal DATA_ANA that is an analog signal converted from the image data DATA_DIG of a digital signal, and a data signal transfer unit 222 configured to transfer an output signal of the buffer 221, i.e., the buffered data signal, to the column line CL to thereby drive the column line CL. The buffer 221 may be implemented with a unit gain amplifier, and buffers the data signal DATA_ANA between an RC load of a panel and the driving circuit. The data signal transfer unit 222 is configured with a transfer gate, which is identical to the preset signal transfer unit 212.

Figure 6:
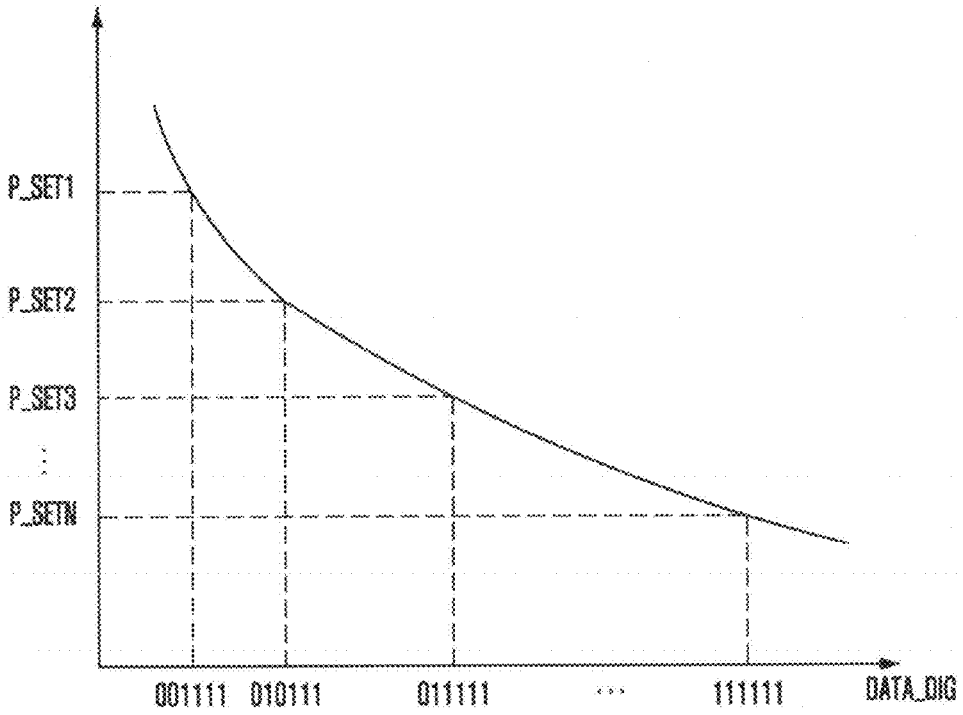
FIG. 6 is a graph illustrating an example of a method of generating a preset signal in FIG. 5.

The preset signals P_SET1 to P_SETN may be preset to correspond to the image data DATA_DIG as shown in FIG. 6. For example, when the image data DATA_DIG has 6-bit data, i.e., from '000000' to '111111', the preset signals P_SET1 to P_SETN have voltage or current levels corresponding to the data of '000000' to '111111', respectively. That is, the preset signal P_SET1 has a level corresponding to '001111'; the preset signal P_SET2 has a level corresponding to '010111'; the preset signal P_SET3 has a level corresponding to '011111'; and the preset signal P_SETN has a level corresponding to '111111'. The voltage or current levels of the preset signals P_SET1 to P_SETN may vary depending on a gamma correction curve or DAC conditions and the number of shared column lines.

Further, the column data driving circuit 200 further includes a D/A converter 230 configured to convert the image data DATA_DIG of a digital signal into the data signal DATA_ANA of an analog signal. The D/A converter 230 receives n-bit image data DATA_DIG and $2^n$ number of analog signals, and selectively outputs one of the $2^n$ number of the analog signals, which corresponds to the currently input image data.

Figure 7:
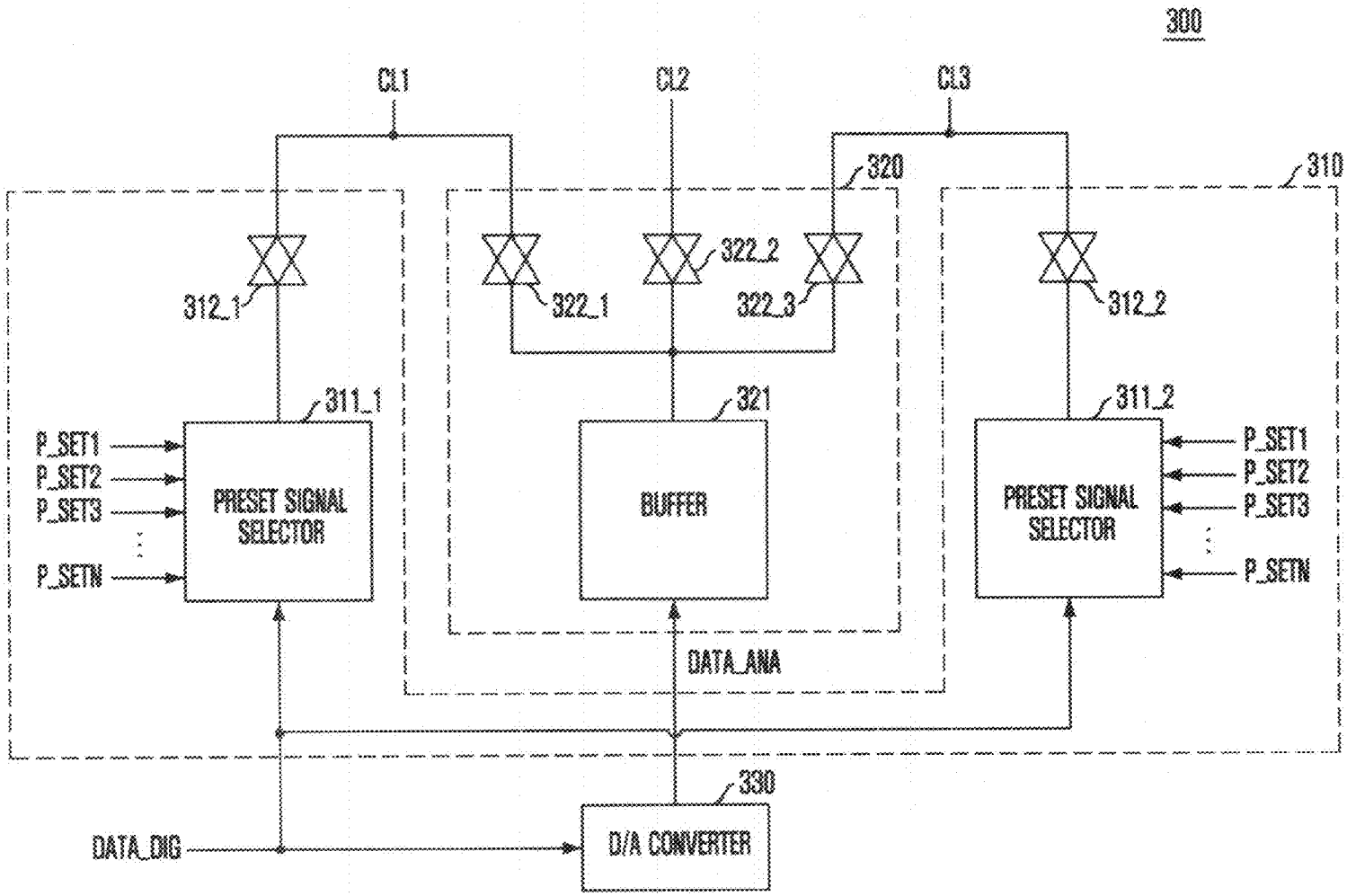
FIG. 7 is a block diagram illustrating an example of a column data driving circuit in accordance with another general aspect.

FIG. 7 is a block diagram illustrating an example of a column data driving circuit 300 in accordance with another general aspect. As an example of the general aspect, a driving circuit of driving three column lines will be described.

Referring to FIG. 7, similarly to the column data driving circuit 200, the column data driving circuit 300 includes a precharge unit 310 and a driving unit 320. However, all the column lines CL1 to CL3 are not precharged but a column line, which is first driven through the driving unit 320, is not precharged. That is, one of the column lines CL1 to CL3, which is driven using a data signal DATA_ANA through the driving unit 320, e.g., a second column line CL2, is not precharged by the precharge unit 310. Therefore, the precharge unit 310 is only provided for precharging the column lines CL1 and CL3.

Figure 8:
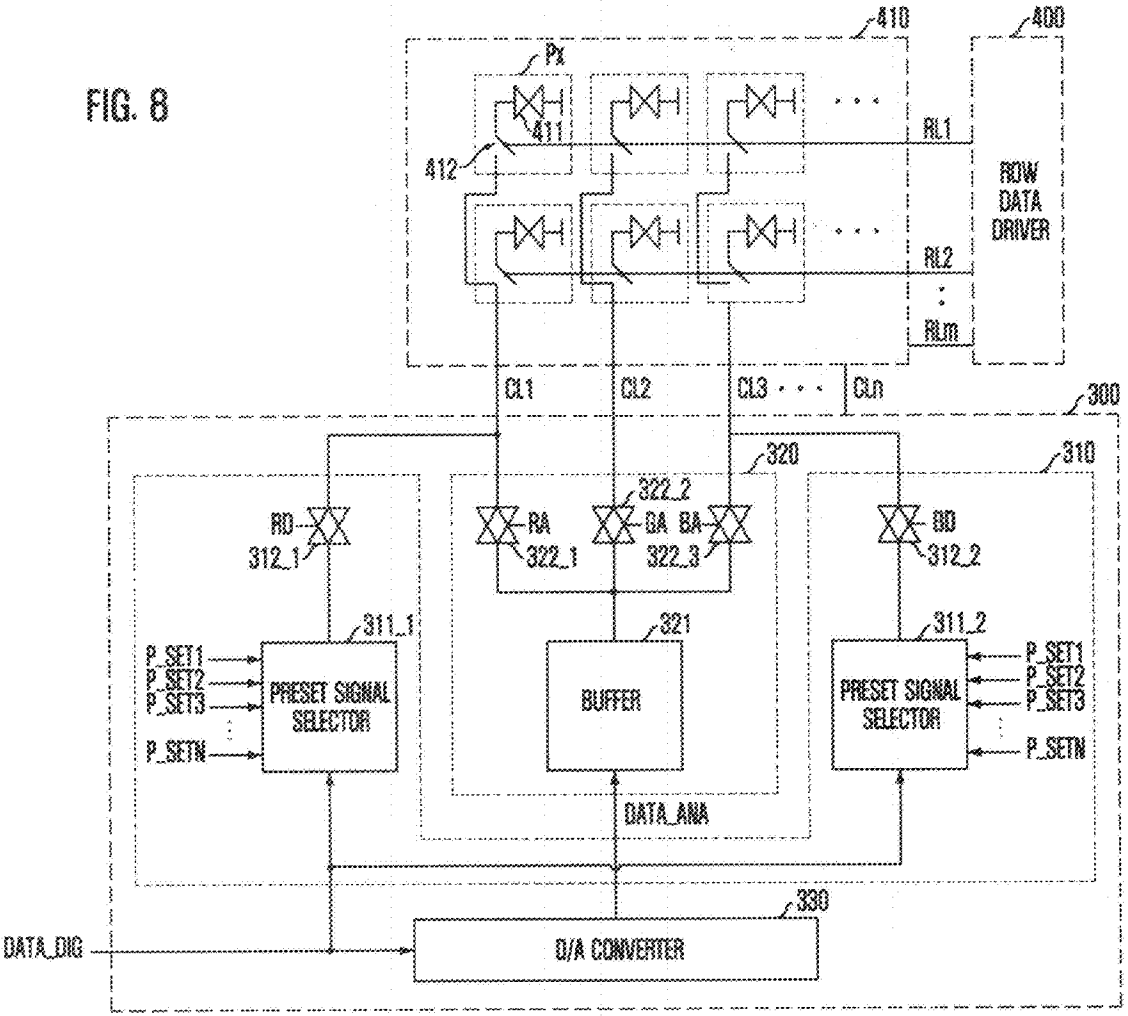
FIG. 8 is a block diagram illustrating an example of a display device including the column data driving circuit of FIG. 7.

FIG. 8 is a block diagram of a display device including the column data driving circuit 300 of FIG. 7.

Referring to FIG. 8, the display device includes a display panel 410, a row data driver 400, and a column data driver 300. The display panel 410 includes pixels arranged in regions where a plurality of row lines RL1 to RLm and a plurality of column lines CL1 to CLn cross each other. The row data driver 400 drives the plurality of row lines RL1 to RLm. The column data driver 300 drives the plurality of column lines CL1 to CLn.

The column data driver 300 may have the same configuration as the column data driving circuit shown in FIG. 7. For example, the column data driver 300 includes a precharge unit 310 configured to precharge the column lines CL1 and CL3 according to a plurality of preset signals P_SET1 to P_SETN corresponding to image data DATA_DIG, and a driving unit 320 configured to drive the column lines CL1 to CL3 in response to the data signal DATA_ANA corresponding to the image data DATA_DIG.

The display panel 410 may be based on amorphous silicon which is cheaper than low temperature polysilicon (LTPS) in consideration of fabrication cost. Also, the display panel 410 may be based on LTPS. The pixel Px may include a liquid crystal 411 and a switch 412. Alternatively, the pixel Px may be formed of organic light-emitting (OLE) material instead of the liquid crystal.

The display device further includes a preset signal generator (not shown) configured to generate the preset signals P_SET1 to P_SETN according to the image data DATA_DIG. The preset signal generator may be provided inside or outside an integrated circuit having the column data driver 300.

In FIG. 8, although one buffer 321 performs a time-sharing operation to drive three column lines CL1 to CL3, it is merely exemplarily illustrated. Thus, number of the column lines driven through the time-sharing method is not limited to three, but it can be appropriately adjusted depending on the characteristics of the display panel 410, for example, RC delay.

Figure 9:
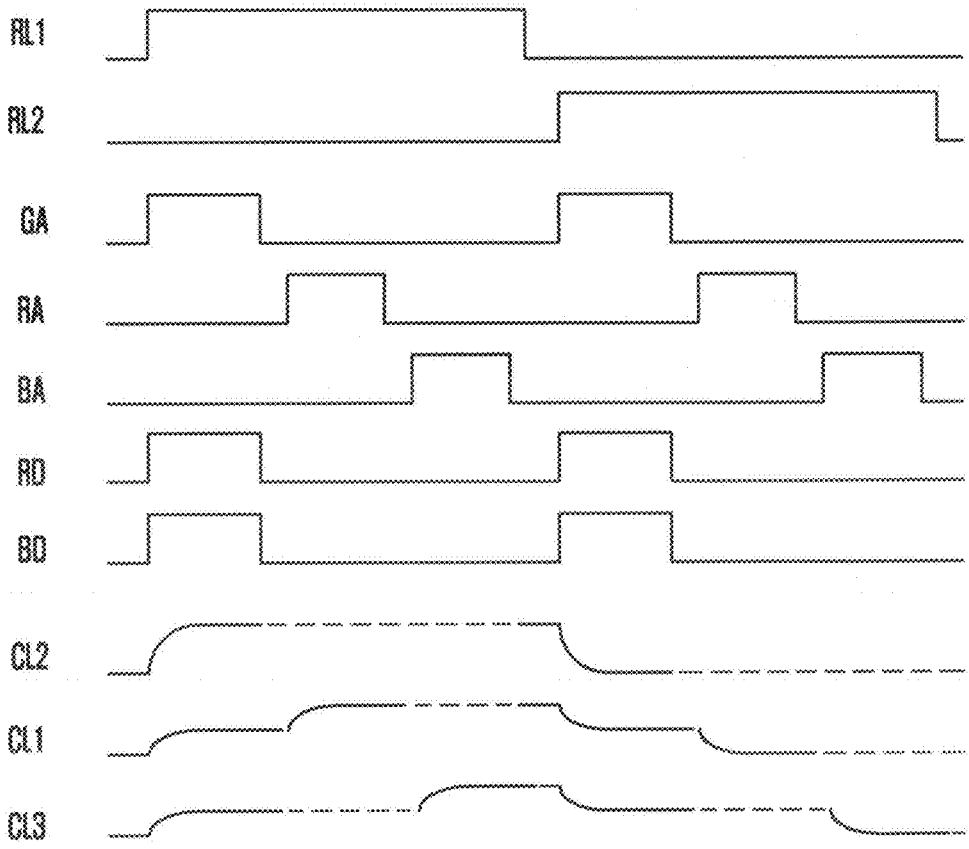
FIG. 9 is an operation waveform diagram illustrating an example of the display device of FIG. 8.

FIG. 9 is an operation waveform diagram of the display device of FIG. 8.

Referring to FIG. 9, the row data driver 400 sequentially applies scan pulses to the row lines RL1 to RLm to thereby enable the row lines RL1 to RLm. For instance, an enabled duration of the row line RL1, i.e., a horizontal duration during which the row line RL1 is enabled to a logic high level, is time-shared by three. During this duration, first control signals GA, RA and BA are activated to a logic high level in sequence.

When the first control signal GA of a logic high level is input, the data signal DATA_ANA is transferred to a second column line CL2 by a data transfer unit 322_2 of the driving unit 320 so that the second column line CL2 is driven according to the data signal DATA_ANA. At this time, second control signals RD and BD of a logic high level are simultaneously input whereby preset signal transfer units 312_1 and 312_2 of the precharge unit 310 precharge first and third column lines CL1 and CL3 using a preset signal corresponding to the image data DATA_DIG. That is, the first and third column lines CL1 and CL3 are preliminarily driven using the selected preset signal while the second column line CL2 is being driven using the actual data signal DATA_DIG.

After completing the precharging of the first and third column lines CL1 and CL3, the second control signals RD and BD change to a logic low level to turn off the preset signal transfer units 312_1 and 312_2. Accordingly, the preset signal selected through the preset signal selectors 311_1 and 311_2 cannot be transferred to the first and third column lines CL1 and CL3, but is cut off by the preset signal transfer units 312_1 and 312_2.

When the first control signal RA of a logic high level is input, the data signal transfer unit 322_1 is turned on to transfer the data signal DATA_ANA to the first column line CL1. That is, the first column line CL1 precharged using the corresponding preset signal is driven according to the data signal DATA_ANA received through the data signal transfer unit 322_1.

The third column line CL3 is driven in the same manner as the method of driving the first column line CL1. That is, when the first control signal BA of a logic high level is input, the data signal transfer unit 322_3 is turned on to transfer the data signal DATA_ANA output from the buffer 321 to the third column line CL3. The third column line CL3 precharged by the corresponding preset signal is driven according to the data signal DATA_ANA transferred through the data signal transfer unit 322_3.

The operation waveform diagram of the column lines CL1 to CL3 obtained through the driving method is shown in FIG. 9. In the operation waveform diagram of the column lines CL1 to CL3, a solid line denotes a duration during which the preset signal or the data signal is transferred through the precharge unit 310 or the driving unit 320 to drive the column lines CL1 to CL3, and a dotted line denotes a floating duration during which the preset signal transfer units 312_1 and 312_2 and the data signal transfer units 322_1 and 322_3 are all turned off so that they are isolated from the column lines.

Figure 4:
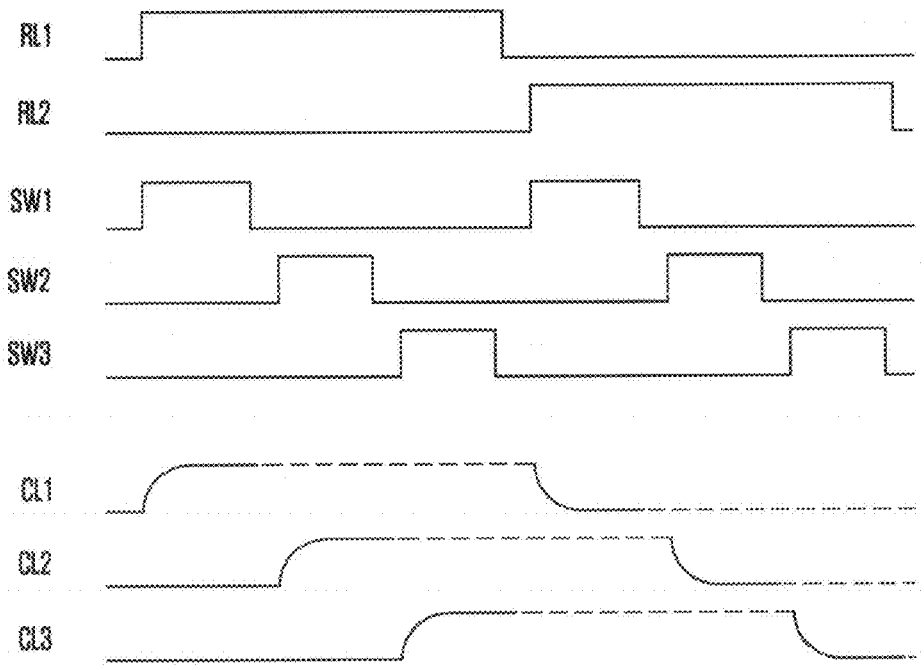
FIG. 4 (RELATED ART)
FIG. 4 is an operation waveform diagram of the LCD of FIG. 3.

Comparing the operation waveform diagram of FIG. 9 with that of FIG. 4, a great difference between them is precharging the corresponding column line to a predetermined level before driving the data signal. Through the precharging operation, the quantity of charges to be driven by the buffer 321 of the driving unit 320 can be reduced, and thus a settling time margin can be improved in spite of the same time delay of the display panel 410.

In FIG. 9, an example of a driving sequence of the column lines CL1 to CL3 is illustrated; however, any one of the column lines CL1 to CL3 can be performed through the same driving method irrespective of the driving sequence. Further, although it is illustrated that the column lines CL1 to CL3 are simultaneously precharged through the precharge unit 310, it is only illustrated as an example. Therefore, number of the precharged column lines may vary if necessary.

Figure 10:
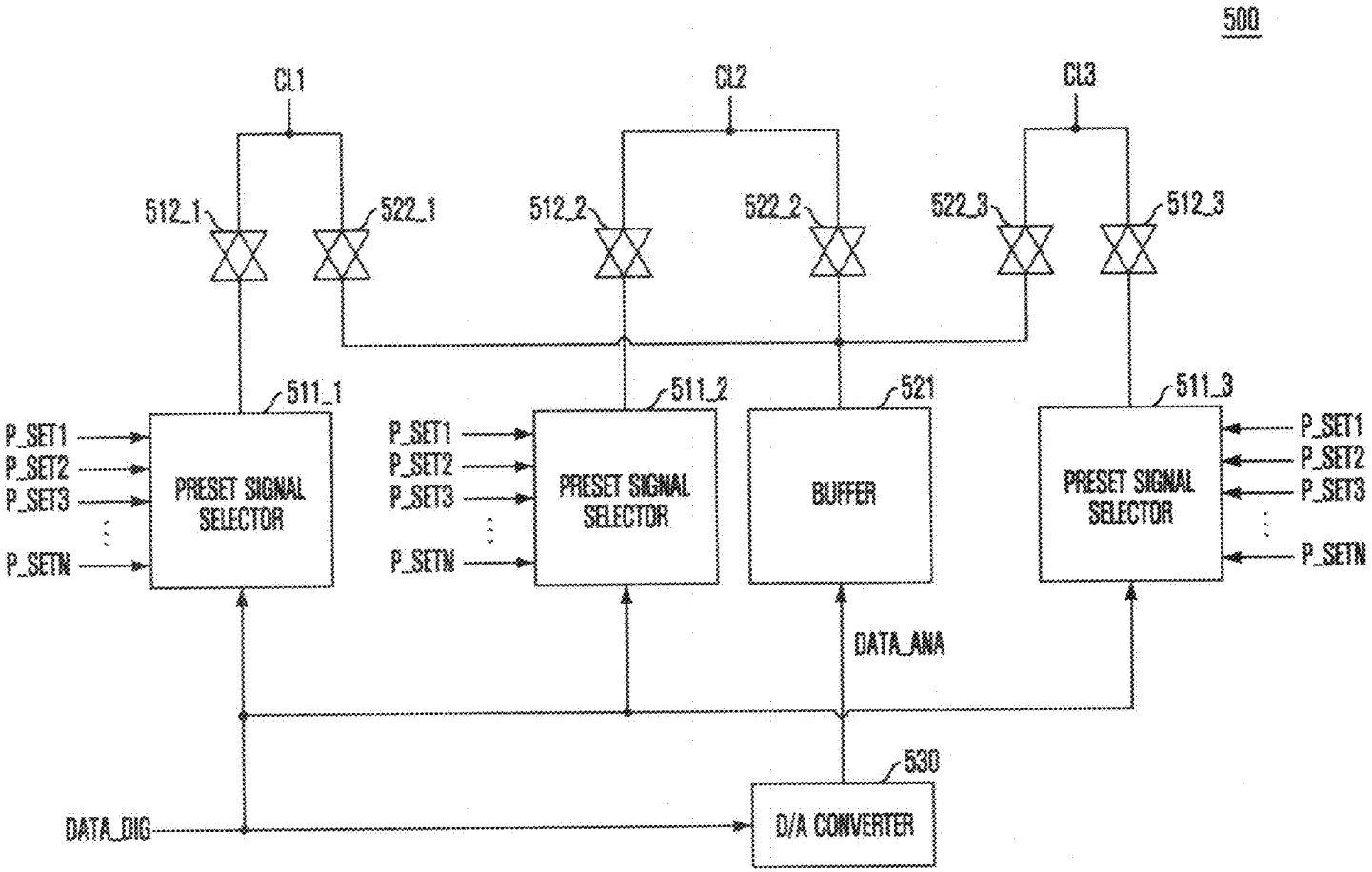
FIG. 10 is a block diagram illustrating an example of a column data driving circuit in accordance with yet another general aspect.

FIG. 10 is a block diagram illustrating an example of a column data driving circuit 500 in accordance with yet another general aspect. As an example of the general aspect, a driving circuit of driving three column lines will be described.

Referring to FIG. 10, the column data driving circuit 500 is configured to precharge all column lines CL1 to CL3, which differs from the column data driving circuit 300 of FIG. 7. That is, all the column lines CL1 to CL3 are precharged for a horizontal duration by a corresponding preset signal transferred from a precharge unit.

Figure 11:
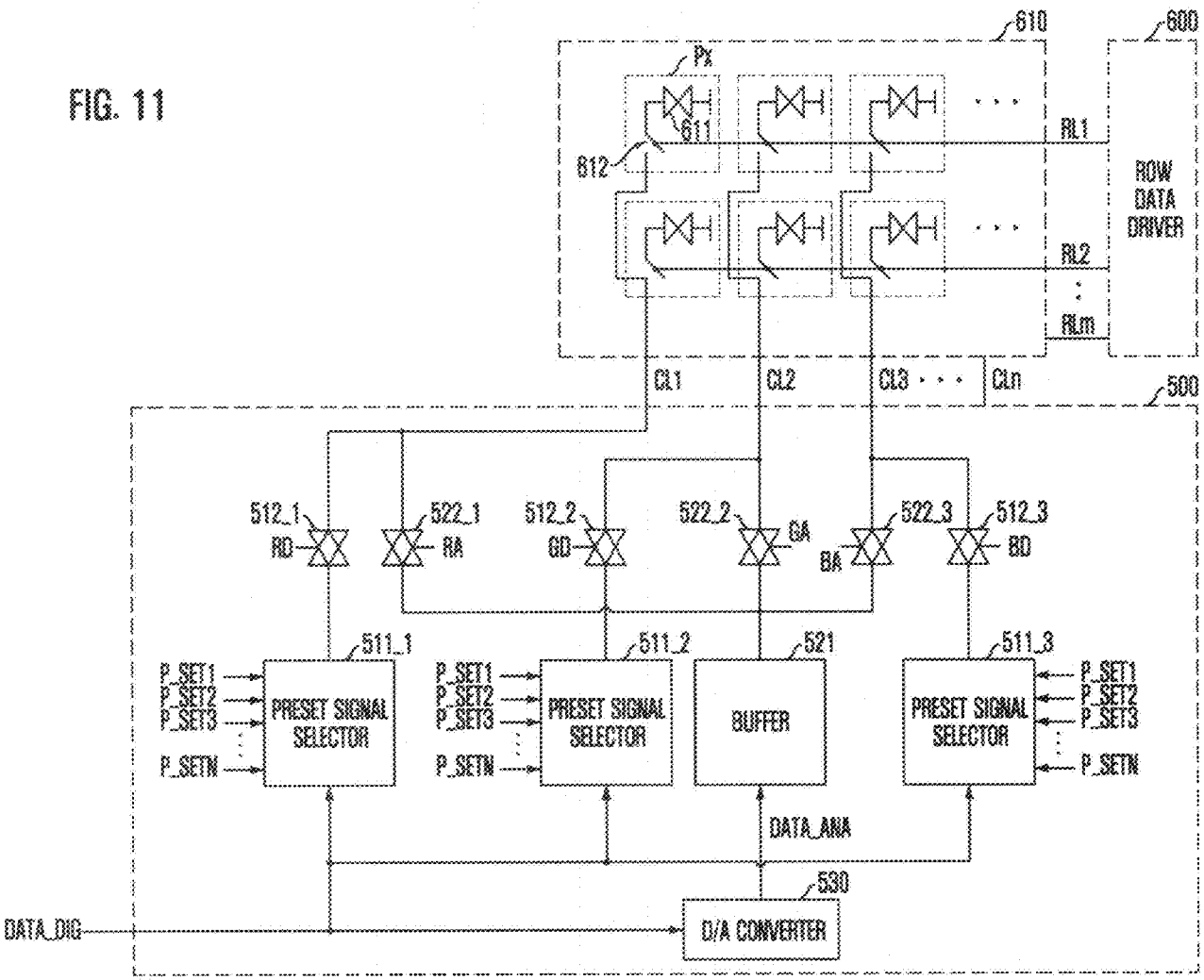
FIG. 11 is a block diagram illustrating an example of a display device including the column data driving circuit of FIG. 10.

FIG. 11 is a block diagram of a display device including the column data driving circuit 500 of FIG. 10.

Referring to FIG. 11, the display device includes a display panel 610, a row data driver 600, and a column data 10 driver 500. The display panel 610 includes pixels Px arranged in regions where a plurality of row lines RL1 to RLm and a plurality of column lines CL1 to CLn cross each other. The row data driver 600 drives the plurality of row lines RL1 to RLm. The column data driver 500 drives the plurality of column lines CL1 to CLn.

The column data driver 500 has the same configuration as the column data driving circuit shown in FIG. 10.

Figure 13:
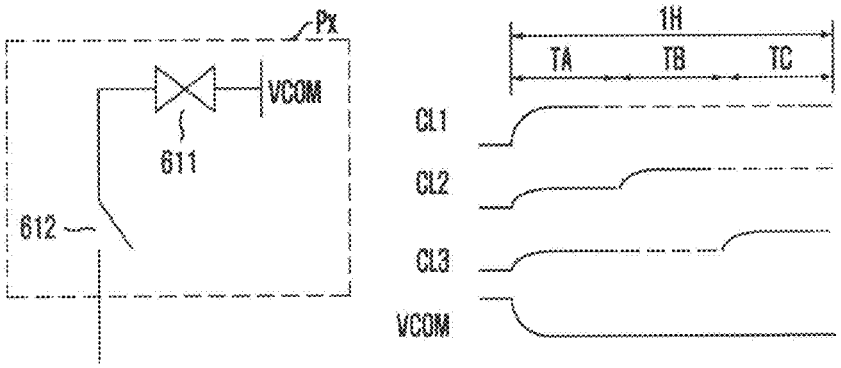
FIG. 13 illustrates an example of a method of controlling a common electrode voltage (VCOM) of a pixel.

In accordance with a control method of a common electrode voltage VCOM in a driving method of the display panel 610, the common electrode voltage VCOM of the pixel Px alternates with the column line, as illustrated in FIG. 13. At this time, a voltage level of the common electrode varies while a specific row line is driven, that is, during one horizontal duration (i.e., 1H duration) when the specific row line is enabled. The common electrode voltage VCOM during the duration TA may differ from the common electrode voltage VCOM during the duration TC. Because the common electrode voltage VCOM during the duration TA differs from that during the duration TC although a target voltage or current for driving the corresponding column line may reach an accurate value, the quantity of charges accumulated in the pixel Px is offset, thus affecting image quality after all.

Therefore, a driving sequence of the column lines CL1 to CLn, which are driven according to the data signal DATA_ANA, is alternately changed in every horizontal duration during which each of the row lines RL1 to RLm is enabled. Resultantly, offset values between the column lines occurring in every row line are canceled each other so that it is possible to improve image quality.

Figure 12:
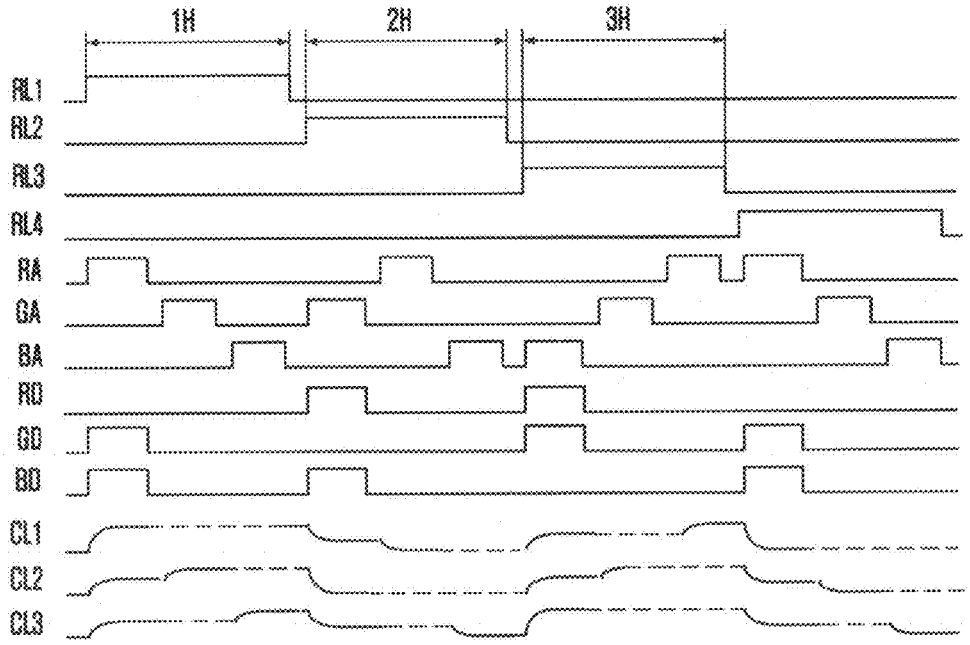
FIG. 12 is an operation waveform diagram illustrating an example of the display device of FIG. 11.

FIG. 12 is an operation waveform diagram of the display device of FIG. 11. Referring to FIG. 12, the driving sequence of the column lines driven according to the data signal DATA_ANA is alternately changed in every horizontal duration 1H to 3H during which each row line RL1 to RLm is enabled. For example, the driving sequence changes in sequence of CL1, CL2 and CL3 during the horizontal duration 1, changes in sequence of CL2, CL1 and CL3 during the horizontal duration 2, and then changes in sequence of CL3, CL2 and CL1 during the horizontal duration 3.

A conventional driving method of using a time-sharing technique of column lines is greatly affected by a time delay of a panel, and thus applicable to only a panel such as an LTPS-based panel having a short parasitic delay time. While an amorphous silicon-based panel is lower in fabrication cost than the LTPS-based panel, the ON resistance of a TFT used as a switch of a pixel in the amorphous silicon-based panel is considerably high, necessitating several tens of microseconds to charge the pixel in general. For this reason, a time-sharing driving method of the column lines should be restrictively applied to specific kinds of panels.

According to the teachings above, however, it is possible to time-share column lines regardless of a parasitic time delay of a panel. This allows an area of a column data driver to be significantly reduced, and power consumption to be reduced due to a decrease in number of buffers.

As described above, although a number of aspects have been described, it is noted that the aforesaid aspects are provided merely for the purpose of general explanation such that various modifications may be made. For example, general aspects illustrate examples of LCDs; however, general aspects can be applied to overall flat panel display (FPD) fields such as LTPS, organic light-emitting diode (OLED), and plasma display panel (PDP) drivers. While general aspects have has been described, it will be apparent to those skilled in the art that other implementations are within the scope of the following claims.

What is claimed is:

1. A column data driving circuit, comprising:

a precharge unit configured to receive a plurality of preset signals and image data, the preset signals being adaptively established according to at least a range of values of the image data, and precharge a first set of column lines comprising a plurality of column lines based on one of the received plurality of preset signals that corresponds to the received image data while never precharging a second set of column lines; and a driving unit configured to receive a data signal corresponding to the image data, drive the second set of column lines during the precharging of the first set of column lines in response to the data signal, and sequentially drive the precharged first set of column lines in response to the data signal, wherein the precharging of the first set of column lines and the driving of the second set of column lines occur substantially simultaneously at each horizontal duration, wherein a column line, which is first driven through the driving unit is not precharged by the precharge unit, wherein the column data driving circuit is configured to simultaneously pulse (i) a first control signal from the driving unit to drive the second set of column lines and (ii) a second control signal from the precharge unit to precharge the first set of column lines.

2. The column data driving circuit of claim 1, wherein the precharge unit comprises a preset signal selection unit and a preset signal transfer unit, the preset signal selection unit being configured to select one of the plurality of preset signals, and the preset signal transfer unit being configured to transfer the selected one of the plurality of preset signals to the first set of column lines to be precharged.

3. The column data driving circuit of claim 2, wherein the preset signal selection unit comprises a decoder or a multiplexer.

4. The column data driving circuit of claim 2, wherein the preset signal transfer unit comprises a transfer gate.

5. The column data driving circuit of claim 1, wherein the driving unit comprises a buffer and a data signal transfer unit, the buffer being configured to buffer the data signal, and the data signal transfer unit being configured to transfer the buffered data signal to the second set of column lines to be driven or the precharged first set of column lines to be sequentially driven.

6. The column data driving circuit of claim 5, wherein the data signal transfer unit comprises a transfer gate.

7. The column data driving circuit of claim 1, further comprising a digital-to-analog (DA) converter configured to convert the image data into the data signal, the image data being digital, and the data signal being analog.

8. A display device, comprising:

a display panel comprising pixels arranged in regions where a plurality of row lines and a plurality of column lines cross each other;

a row data driver configured to drive the plurality of row lines; and a column data driver configured to drive the plurality of column lines, the column data driver comprising a precharge unit and a driving unit, the precharge unit being configured to receive a plurality of preset signals and image data, the preset signals being adaptively established according to at least a range of values of the image data, and precharge a first set of column lines comprising a plurality of column lines based on one of the received plurality of preset signals that corresponds to the received image data while never precharging a second set of column lines; and the driving unit being configured to receive a data signal corresponding to the image data, drive the second set of column lines during the precharging of the first set of column lines in response to the data signal, and sequentially drive the precharged first set of column lines in response to the data signal, wherein the precharging of the first set of column lines and the driving of the second set of column lines occur substantially simultaneously at each horizontal duration, wherein a column line, which is first driven through the driving unit is not precharged by the precharge unit, wherein the column data driver is configured to simultaneously pulse (i) a first control signal from the driving unit to drive the second set of column lines and (ii) a second control signal from the precharge unit precharge the first set of column lines.

9. The display device of claim 8, wherein the precharge unit comprises a preset signal selection unit and a preset signal transfer unit, the preset signal selection unit being configured to select one of the plurality of preset signals, and the preset signal transfer unit being configured to transfer the selected one of the plurality of preset signals to the first set of the column lines to be precharged.

10. The display device of claim 9, wherein the preset signal selection unit comprises a decoder or a multiplexer and wherein the precharging of the first set of column lines and driving of the second set of column lines omits an initializing precharge-only period devoid of driving.

11. The display device of claim 9, wherein the preset signal transfer unit comprises a transfer gate.

12. The display device of claim 8, wherein the driving unit comprises a buffer and a data signal transfer unit, the buffer being configured to buffer the data signal, and the data signal transfer unit being configured to transfer the buffered data signal to the second set of column lines to be driven or the precharged first set of the column lines to be sequentially driven.

13. The display device of claim 12, wherein the data signal transfer unit comprises at least one of an n-type metal-oxide semiconductor (NMOS) transistor, a p-type metal-oxide semiconductor (PMOS) transistor, or both.

14. The display device of claim 8, further comprising a digital-to-analog (DA) converter configured to convert the image data into the data signal, the image data being digital, and the data signal being analog.

15. The display device of claim 8, wherein the pixels comprise a liquid crystal or organic light-emitting material.

16. The display device of claim 8, further comprising a preset signal generator configured to generate the plurality of signals to correspond to the image data.

17. The display device of claim 8, wherein the display panel comprises an amorphous silicon-based display panel.

18. The display device of claim 8, wherein the display panel comprises a low temperature polysilicon (LTPS)-based display panel.

19. The display device of claim 8, wherein the column data driving circuit is further configured to adaptively establish the preset signals according to the range of values of the image data and a characteristic of the display panel.

20. A column data driving circuit, comprising:

a driver configured to selectively drive a first column line amongst a plurality of column lines shared between a common buffer;

a precharger configured to receive a plurality of preset signals generated according to an image data, and simultaneously precharge the plurality of column lines according to the respectively corresponding plurality of preset signals except for never precharging the first column line, the precharging of the plurality of column lines being substantially simultaneous with the driving of the first column line, wherein a column line, which is first driven through the driving unit is not precharged, wherein the column data driving circuit is configured to simultaneously pulse (i) a first control signal from the driver to drive the first column line and (ii) a second control signal from the precharger to precharge the plurality of column lines.

21. The column data driving circuit of claim 1, wherein the column data driving circuit is configured to pulse another first control signal from the driving unit, after the simultaneous pulse, to drive the first set of column lines.

22. The display device of claim 8, wherein the column data driver is configured to pulse another first control signal from the driving unit, after the simultaneous pulse, to drive the first set of column lines.

* * * * *